US006533901B2

(12) United States Patent
Taipale

(10) Patent No.: US 6,533,901 B2
(45) Date of Patent: Mar. 18, 2003

(54) PAPER MACHINE FABRIC

(75) Inventor: Seppo Taipale, Siilinjärvi (FI)

(73) Assignee: Tamfelt Oyj ABP, Tampere (FI)

( * ) Notice: Subject to any disclaimer, the term of this patent is extended or adjusted under 35 U.S.C. 154(b) by 0 days.

(21) Appl. No.: 09/880,874

(22) Filed: Jun. 15, 2001

(65) Prior Publication Data

US 2002/0060039 A1 May 23, 2002

(30) Foreign Application Priority Data

Jun. 26, 2000 (FI) ..... 001516

(51) Int. Cl.[7] ..... D03D 13/00; D21F 1/10
(52) U.S. Cl. ..... 162/348; 162/903; 139/425 A
(58) Field of Search ..... 139/383 A, 383 AA, 139/425 A; 162/306, 348, 358.1, 358.2, 358.3, 358.4, 900, 901, 902, 903, 904; 28/142, 151; 34/95, 111, 123; 442/181, 203, 204, 206, 207

(56) References Cited

U.S. PATENT DOCUMENTS 4,821,780 A * 4/1989 Tate ..... 139/383 A
4,989,647 A * 2/1991 Marchand ..... 139/383 A
5,458,693 A 10/1995 Codorniu ..... 139/383 A
5,482,567 A * 1/1996 Barreto ..... 139/383 A
5,490,543 A * 2/1996 Fujisawa ..... 139/383 A
5,829,489 A * 11/1998 Kuji ..... 139/383 A

* cited by examiner

*Primary Examiner*—Steven P. Griffin
*Assistant Examiner*—Eric Hug
(74) *Attorney, Agent, or Firm*—Oliff & Berridge, PLC

(57) ABSTRACT

A paper machine fabric comprising two separate layers which are made of a yarn system made up of warp and weft yarns forming the paper side and a yarn system made up of warp and weft yarns forming the machine side. The yarn system forming the paper side is arranged to comprise two warp systems and two weft systems. The warp system made up of top warps of the layer forming the paper side is interconnected with the warp system of the structure forming the machine side by means of binder yarns by arranging the binder yarns at the paper-side binding point to press the top warps inside the fabric in such a manner that the binder yarns are at the binding point under the surface of the fabric.

9 Claims, 1 Drawing Sheet

PAPER MACHINE FABRIC

Figure 1:
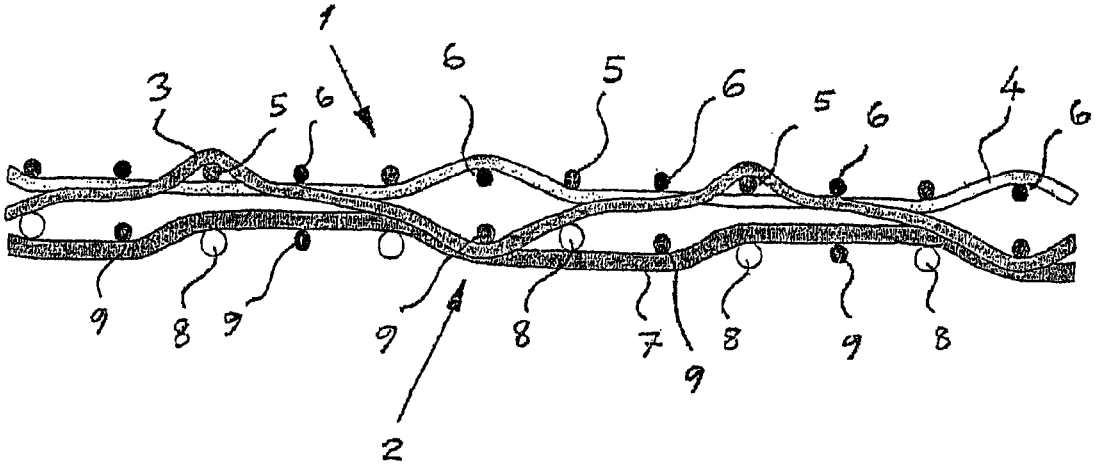

The invention relates to a paper machine fabric which comprises two separate layers made of two separate yarn systems, the yarn system made up of the warp and weft yarns forming the paper side and the yarn system made up of the warp and weft yarns forming the machine side, which are arranged to form independent structures in the warp and weft directions of the fabric, and which structures are bound together by means of binder yarns.

Conventional triple layer paper machine fabrics have two separate layers, the paper-side layer and the machine-side layer, and the layers are interconnected mainly by means of a binder weft. On the paper side, the binding is done in such a manner that the binder weft serving as a binder yarn runs alternately in phase with the cross yarn and alternately in different phase with said yarn. This results in that the binder yarn does not run straight in the cross direction. Further, at the binding point on the paper side, the binder yarn remains at nearly the same level with other surface yarns. On the machine side, the binder yarn is slightly more inside the fabric. As a result of this, the binder yarn also remains twisted in the z direction.

The twists of the binder yarn in the cross and z directions cause the binder yarn and the cross and longitudinal yarns to chafe against each other. As a result of the chafing, the yarns wear initially at the binding points of the binder yarn and later when the fabric loosens as a result of the chafing, the inner structures on the paper and machine sides chafe more and more against each other. With the wear of the inside of the fabric, the binder yarn begins to leave marking patterns on the surface of the paper, because the fabric has become thinner than its original thickness on the inside of the fabric, but the binder yarn has remained in its original dimension. A long-lasting inside wear may also cause the layers to separate from each other.

Thus, the binder weft wears the fabric from the middle, on the inside. This is due to the fact that the peripheral speeds of the paper-side layer and the machine-side layer are different in a paper machine. Another reason is the filler that enters the wire in a paper machine. The filler and the binder weft wear recesses in the warp yarns and the fabric flattens. Because of this, the binder weft remains looser and causes marking, for instance. In the worst case, the layers can even separate from each other as explained above. A further problem is that the binder weft pulls the warp yarn it binds slightly inwards on the paper side. This depression causes marking. The binder weft also causes an extra yarn flow on the surface of the fabric on the paper side. At this point, the fabric is denser and water draining from the paper web cannot evenly exit through the wire, which causes marking. In conventional fabrics, the binder weft twists from the paper side of the fabric to the machine side and back. The twisting is quite sharp and because of it, the layers on the paper and machine sides cannot come close to each other, thus making the fabric thick. This is why the fabric has a large water space. A wire having the above-mentioned structure carries a lot of water with it, which may cause splashing in the paper machine. Splashing makes the paper machine structures dirty and causes defects in the paper web, at worst even holes. A large water space of a wire also causes rewetting, in which case water from the wire re-enters the paper web and causes a reduction in dry content.

A further problem with conventional triple layer wires is that the wire stretches in the paper machine. When examining the layers on the paper and machine sides separately, it can be noted that the paper-side layer stretches considerably more than the machine-side layer, which is due to the fact, for instance, that in the conventional structure, the warp density is the same on the paper side and machine side and the paper-side warp is thinner than the machine-side warp. In addition, the stretching of the paper-side layer in relation to that of the machine-side layer is increased by the denser twisting of the warps in the paper-side layer. The more the wire stretches in the machine direction, the more it also narrows in the cross direction. Due to the stretching difference between the layers, the layer tries to narrow more than the machine-side layer. Because of this, the wire may become streaked and cause profile irregularities in the paper web. A speed difference in the top and bottom wires causes wear on the paper side of the wires, which together with a heavily worn machine side causes the wire to break.

It is an object of the invention to provide a paper machine fabric, by means of which the drawbacks of prior art can be eliminated. This is achieved by the paper machine wire of the invention, which is characterized in that the yarn system forming the paper side is arranged to comprise two warp systems which are made up of top warps and additional warps, and two weft systems which are made up of top wefts and additional wefts, whereby the top wefts are arranged to bind to the top warps only and the additional wefts to the additional warps only, that the warp system made up of the top warps of the layer forming the paper side is bound together with the warp system of the structure forming the machine side by means of binder yarns by arranging the binder yarns at the paper-side binding points to press the top warps inside the fabric in such a manner that the binder yarns are at the binding point substantially below the fabric surface, and that the additional warps are, between the binding points, arranged to run between the layer forming the paper side and the layer forming the machine side.

The invention provides above all the advantage that the binder yarn twists in the cross and z directions less than before and thus does not cause inside wearing. In addition, because the binder yarn is in the z direction straighter than before, the wire can be made substantially thinner. In this connection, it should be remembered that in a paper machine, the wire is washed during the return cycle. When the pulp spray hits the wire, it is preferable for the operation of the wire that its water content is as low as possible and evenly distributed. The thin wire structure of the invention is easy to wash and the impingement drying used in modern paper machines dries such a wire structure evenly. The machine-direction stretch difference between the layers of the wire of the invention is smaller than in conventional triple layer wires. This is due to the fact, for instance, that the warp density in the paper-side layer is higher than that on the machine side, whereby the load is more evenly distributed between layers than in a conventional triple layer wire. The solution of the invention is very flexible, and the binding can be modified as appropriate for each need, it is for instance possible to use binder yarn pairs instead of a binder yarn. A further advantage is that the binder yarn remains inside the fabric, i.e. the binder yam does not come to the paper-side surface and thus does not cause marking. The fabric of the invention does not easily break, because its paper-side warps are not immediately vulnerable to paper-side wear. The paper machine fabric of the invention is also advantageous, because the high yarn density on the paper side gives the paper web a good support.

Figure 2:
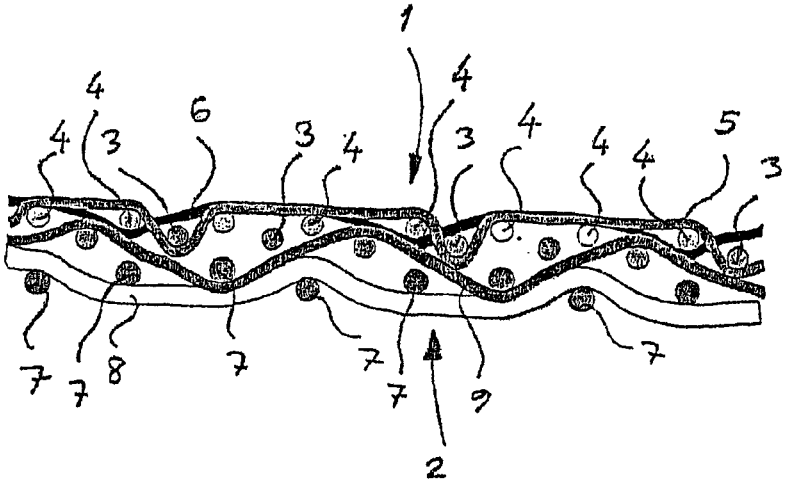

In the following, the invention will be described in greater detail by means of a preferred embodiment shown in the attached drawing, in which FIG. 1 shows the paper machine fabric of the invention in the direction of the weft yarns, and FIG. 2 shows the paper machine fabric of the invention in the direction of the warp yarns.

FIGS. 1 and 2 show schematic views of the paper machine fabric of the invention from different directions. As can be seen in the figures, the paper machine fabric of the invention comprises two separate layers formed of two separate yarn systems, a yarn system 1 made up of warp and weft yarns forming the paper side and a yarn system 2 made up of warp and weft yarns forming the machine side. The layer forming the paper side is in the figures shown as the top layer and the layer forming the machine side correspondingly as the bottom layer. The above-mentioned yarn systems are arranged to form independent structures in the warp and weft directions of the fabric. The structures formed by the yarn systems 1 and 2 are bound together by means of binder yarns.

The above-mentioned facts are known per se to a person skilled in the art, so they are not described in greater detail herein.

According to the essential idea of the invention, the yam system 1 forming the paper side is arranged to comprise two warp systems which are made up of top warps 3 and additional warps 4, and two weft systems which are made up of top wefts 5 and additional wefts 6. The top wefts 5 are arranged to bind to the top warps 3 only and the additional wefts 6 to the additional warps 4 only. In the example of the figures, the additional warps 4 are arranged to overlay with the warps, in other words bottom warps 7, i.e., be stacked over, of the warp system of the structure forming the machine side. The wefts, in other words bottom wefts, of the layer forming the machine side are marked with the reference numeral 8 in the figures. The warp system made up of the top warps 3 of the layer forming the paper side is bound together with the warp system of the structure forming the machine side by means of binder yams 9. The binder yams 9 are arranged at the binding point of the paper side to press the top warps 3 inside the fabric in such a manner that the binder yams 9 are at the binding point below the surface of the fabric. Further, the additional warps 4 are, between the binding points, arranged to run between the layer forming the paper side and the layer forming the machine side.

When examining the machine-side fabric, it can be seen that the machine-side fabric, it can be seen that the machine-side warp yams 7 can be overlayed with either of the paper side warp yams 3, 4. The warp yams 7, 3, 4 can, however, also be arranged to overlap, i.e., not stacked or at an offset, if such a solution is deemed necessary.

In addition, in the application of the figures, the warp density of the layer forming the paper side is twice as high as that of the layer forming the machine side. The weft density of the paper side can also be at least twice as high as that of the machine side.

An essential matter in the paper machine fabric of the invention is that the binder yarns 9 do not come to the surface at all on the paper side of the fabric, but the binding on the paper side is done substantially under the paper surface as seen in the perpendicular direction of the wire. This type of a structure is made possible by a separate warp system of the paper side which allows the warps to press substantially under the paper surface. This is why the binder yarns, too, remain straighter than in earlier solutions in the z direction, and the chafing of the binder yarns against other yarns is eliminated and the difference in peripheral speed between the face side and machine side does not wear the binder yarns. Because the binder yarns do not at all come to the surface of the paper side, there are no binder yarn binding points that cause marking.

The structure of the invention also enables making the wire as thin as possible, because the twisting of the binder yams from the surface of the paper side to the machine side is left out. In the triple layer wires used today, the warp-direction stretching of the paper and machine sides differ considerably from each other. In the structure of the invention, the higher warp density on the face side as compared with the bottom side evens the warp-direction stretching and cross-direction narrowing to be the same on the paper and machine sides. The impact of the differences in tightness on the wire of the paper machine is then minimized and the streakiness of the wire, which affects harmfully the paper grade being made, is eliminated.

In the triple layer wires used today, a possible paper-side wear affects directly the warp yams. In the solution of the invention, this is eliminated by arranging the warp yarns on the face side to be in a way protected against wear. The wear first affects the additional weft yams 6 of the additional yam system and the normal top weft yarns 5.

In the example of the figures, the binder yarns 9 are individual yarns, binder wefts, but this is not the only possibility, but instead of the binder yarns, it is possible to use binder yarn pairs, for instance binder weft pairs.

The embodiment described above is in no way intended to limit the invention, but the invention can be modified freely within the scope of the claims. Therefore, it is clear that the paper machine fabric of the invention or its details need not necessarily be exactly as described in the figures, but other kinds of solutions are possible. It should be noted that the invention is in no way limited to a certain structure, for instance a 3/3-shed structure, but the invention can also be applied to other solutions. Yarn thickness is also not restricted to any particular diameter, but the diameters can be varied as necessary, for instance the warp yarns on the paper side can be of a different thickness. The total surface area of the paper-side warp diameters can, for instance, be at least 60% of the surface area of the machine-side warp diameters.

What is claimed is:

1. A paper machine fabric which comprises two separate layers formed of two separate yam systems, a yam system made up of warp and weft yams forming the paper side and a yam system made up of warp and weft yams forming the machine side, which are arranged to form independent structures in the warp- and weft-directions of the fabric, and which structures are bound together by means of binder yams, wherein the yam system forming the paper side is arranged to comprise two warp systems which are made up of top warps and additional warps, and two weft systems which are made up of top wefts and additional wefts, whereby the top wefts are arranged to bind to the top warps only and the additional wefts to the additional warps only, that the warp system made up of the top warps of the layer forming the paper side is bound together with the warp system of the structure forming the machine side by means of binder yams by arranging the binder yams at paper-side binding points to press the top warps inside the fabric in such a manner that the binder yams are at the said paper-side binding points substantially below the fabric surface, and that the additional warps are, between its binding points, arranged to run between the layer forming the paper side and the layer forming the machine side.

2. A paper machine fabric as claimed in claim 1, wherein the binder yarns are binder yarn pairs.

3. A paper machine fabric as claimed in claim 1, wherein the binder yarns are binder wefts.

4. A paper machine fabric as claimed in claim 1, wherein the warp density of the layer forming the paper side is twice as high as the warp density of the layer forming the machine side.

5. A paper machine fabric as claimed in claim 1, wherein the weft density of the paper side is at least twice as high as the weft density of the machine side.

6. A paper machine fabric as claimed in claim 1, wherein the total surface area of the paper-side warp diameters is at least 60% of the surface area of the machine-side warp diameters.

7. A paper machine fabric as claimed in claim 1, wherein both the paper-side and the machine-side weaving structure is 3/3-shed.

8. A paper machine fabric as claimed in claim 1, wherein the machine-side warp yarns are below on the same line with either of the paper-side warp yarns.

9. A paper machine fabric as claimed in claim 1, wherein the warp yarns are arranged to overlap.

* * * * *

UNITED STATES PATENT AND TRADEMARK OFFICE

CERTIFICATE OF CORRECTION

PATENT NO. : 6,533,901 B2
DATED : March 18, 2003
INVENTOR(S) : Seppo Taipale

It is certified that error appears in the above-identified patent and that said Letters Patent is hereby corrected as shown below:

Title page,
Item [30], please change “001516” to -- 20001516 --.

Signed and Sealed this

Ninth Day of September, 2003

JAMES E. ROGAN
*Director of the United States Patent and Trademark Office*